US005592784A

United States Patent [19]

Nivens

[11] Patent Number: 5,592,784

[45] Date of Patent: Jan. 14, 1997

[54] TRENCH STRUCTURE

[75] Inventor: Kirk N. Nivens, Seabrook, S.C.

[73] Assignee: Forma Block, Inc., Beaufort, S.C.

[21] Appl. No.: 329,833

[22] Filed: Oct. 27, 1994

Related U.S. Application Data

[63] Continuation-in-part of Ser. No. 147,293, Nov. 5, 1993, abandoned.

[51] Int. Cl.[6] ..... E02D 29/14

[52] U.S. Cl. ..... 52/20; 52/169.6; 52/220.5; 52/293.2; 52/604; 404/26

[58] Field of Search ..... 52/293.1–293.3, 52/295, 437–439, 604–606, 611, 612, 592.6, 20, 220.5, 169.6; 405/284, 285, 286; 404/25, 26

[56] References Cited

U.S. PATENT DOCUMENTS

| | | | |
|---|---|---|---|
| 1,024,276 | 4/1912 | Nash . | |
| 1,424,372 | 8/1922 | Neese et al. | 52/609 X |
| 1,687,342 | 10/1928 | MacVeigh | 52/605 |
| 1,785,499 | 12/1930 | Sayers | 52/437 |
| 1,807,138 | 5/1931 | Spelshouse | 52/437 |
| 2,134,637 | 10/1938 | Loucks | 72/41 |
| 2,323,661 | 7/1943 | Hosbein | 52/604 |
| 3,309,832 | 3/1967 | Filsinger | 52/605 |
| 3,549,115 | 12/1970 | Williams | 249/33 |
| 3,802,134 | 9/1974 | McCorvey | 52/93 |
| 3,848,376 | 11/1974 | Elmore | 52/169 |
| 4,174,183 | 11/1979 | Ferns | 404/26 |
| 4,473,985 | 10/1984 | Hunt | 52/593 |
| 4,621,476 | 11/1986 | MacGregor | 52/741 |
| 4,909,010 | 3/1990 | Gravier | 52/604 |
| 4,998,387 | 3/1991 | Geiger | 52/20 |
| 5,120,164 | 6/1992 | Iacocca et al. | 405/284 |
| 5,154,542 | 10/1992 | Klenert | 405/286 |
| 5,214,898 | 6/1993 | Beretta | 52/606 |
| 5,362,175 | 11/1994 | Begin | 52/20 X |
| 5,367,845 | 11/1994 | Hartling | 52/293.1 |

FOREIGN PATENT DOCUMENTS

| | | |
|---|---|---|
| 62-284828 | 12/1987 | Japan . |
| 259061 | 10/1926 | United Kingdom . |

OTHER PUBLICATIONS

Ramsey & Sleeper "Architectural Graphic Standards" (8th ed.) p. 188 1988; Somerset, NJ, by John Wiley & Sons.

Ramsey & Sleeper "Architectural Graphic Standards" (9th ed.) p. 202 1994; Somerset, NJ, by John Wiley & Sons.

*Primary Examiner*—Carl D. Friedman
*Assistant Examiner*—Winnie Yip

[57] ABSTRACT

A trench structure for a drain or chase is presented which can be quickly and economically constructed. A unique cap block, which has a notched face section for accepting a drain grate or trench cover and a laterally offset horizontal support section for retaining a paving member, forms the top rows of the trench side walls.

17 Claims, 3 Drawing Sheets

TRENCH STRUCTURE

This is a continuation in part of patent application Ser. No. 08/147,293 filed on 05 Nov. 1993 of Kirk N. Nivens entitled BLOCK WALL SYSTEM now abandoned.

BACKGROUND OF THE INVENTION

1. Field of the Invention

The invention herein pertains to a trench structure and particularly to a concrete block structure which utilizes a novel cap block design.

2. Description of the Prior Art and Objectives of the Invention

Various foundation wall systems have been utilized in the past in which concrete footings are poured and block walls constructed having a top "cap" block. On-site or "field" forming of concrete structures and control of deflection in concrete forms is labor intensive and requires special care to control quality, resulting in high costs. On-site forms for concrete must be disposed of or be stripped, cleaned and oiled prior to their subsequent use which also requires additional labor and expense.

In U.S. Pat. No. 3,549,115 an on-site poured concrete floor having a notch along the upper front edge for positioning a monolithic wall therein is shown. U.S. Pat. No. 3,802,134 also illustrates a foundation having an upper wall receiving notch. U.S. Pat. No. 5,154,542 demonstrates an earth retaining module which will interlock with similar modules for providing a stabilizing wall system.

None of the prior art systems described above demonstrate a structure having a block wall system as described herein and these previous systems fail to teach the structure and advantages of the present invention. The invention as described allows the construction of trench structures such as drains and floor chases without on-site concrete form work being required to provide the grating or cover notch, to tie the foundation wall to the floor slab, or to form the paving member, offering substantial reduction in construction costs as compared to prior construction techniques. Chases are generally used for enclosing electrical lines, pipes, hydraulic lines or the like.

Another purpose of the block herein is to eliminate the need for field forming of concrete to construct trench drains or floor chases.

Thus, with the present disadvantages and problems associated with prior art trench drains, the present invention was conceived and one of its objectives is to provide a precast cap block and trench block building system which is economical for contractors and building owners.

It is another objective of the present invention to provide a cap block which can be adapted to many varieties of construction styles and techniques.

It is another objective of the present invention to provide a cap block which includes a face section having an upper front edge notch and a support section affixed thereto for retaining a concrete slab or paving member such as asphalt or concrete thereon.

It is yet another objective of the present invention to provide a top or cap block which can be readily formed from concrete and which includes a support section which is laterally offset to insure proper mating by a mason during wall construction.

It is yet still another objective of the present invention to provide a cap block which can be mass produced at a factory and conveniently delivered to a job site for use by a mason in constructing trenches, drains, and chases.

Another object of the invention herein is to provide a continuous straight edge for the termination of asphaltic or concrete pavements adjacent to trench drains or chases.

Various other objectives and advantages of the present invention will become apparent to those skilled in the art as a more detailed description is set forth below.

SUMMARY OF THE INVENTION

The invention herein pertains to a block structure and particularly to a trench whereby the upper or top row block of the sidewalls utilize a novel concrete block which includes a face with a support section formed therewith. The support section has a lesser height for supporting a floor or pavement member while the face section includes an upper notch for receiving a trench cover, grating, or plate. The structure includes a base comprising a ground poured concrete footing slab with the desired number of rows of conventional concrete blocks placed thereon along the sidewalls of the trench. Atop the conventional concrete blocks (or directly upon the foundaton) are blocks of the invention as will be further described herein having a notched face section and a rearwardly extending support section which is offset to provide structural integrity during the building process.

The unique design of the top or cap block includes integrally cast keyed male and female ends, which when laid end to end with common mortared joints, provides increased lateral strength for roll out protecton during construction and use. In trench drains, chases and other applications these structural advantages are quickly realized.

DESCRIPTION OF THE PREFERRED EMBODIMENTS

Figure 3:
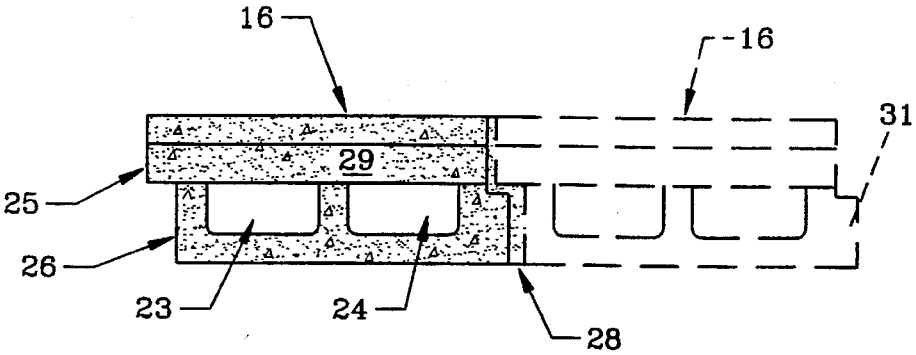
FIG. 3 pictures a top view of the block of FIG. 2 with a second such block shown in ghost fashion as positioned in a wall.
Figure 8:
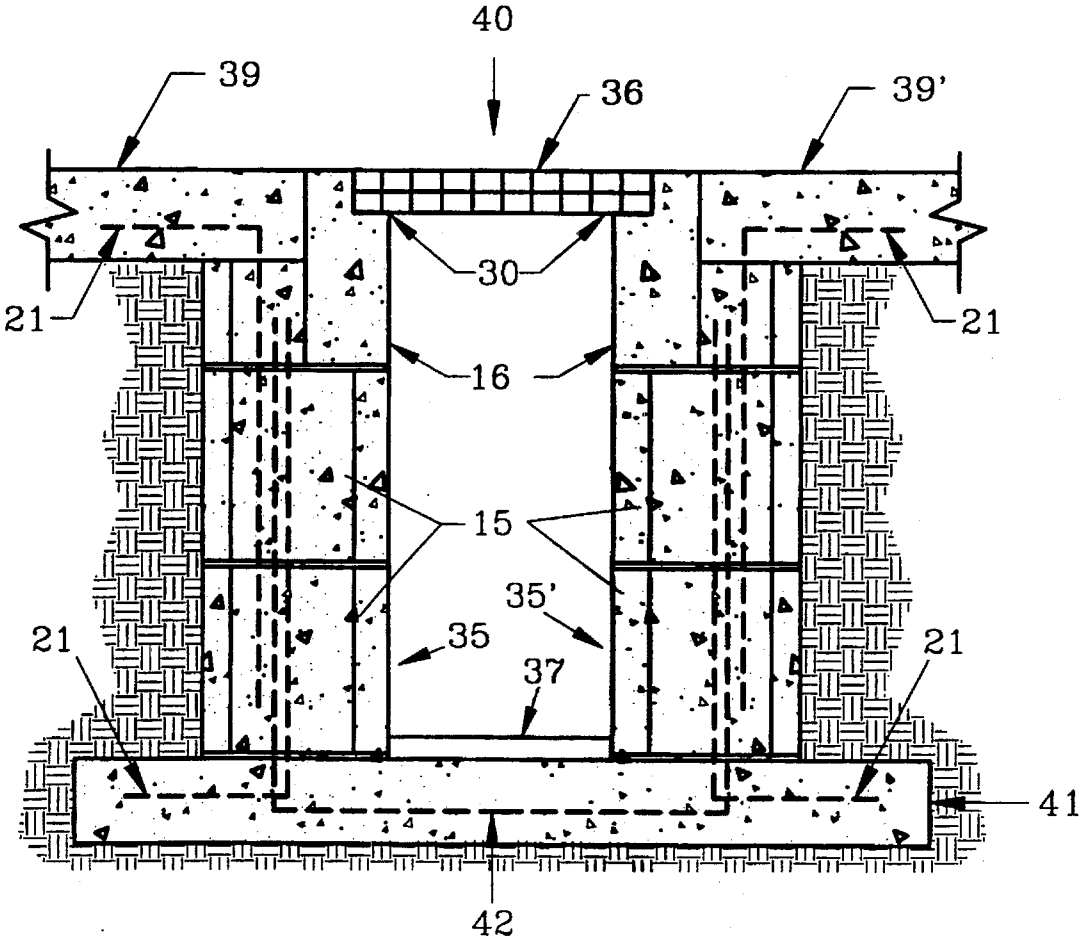
FIG. 8 shows a trench drain utilizing the wall block described herein.

The preferred trench structure of the invention is shown in FIG. 8 whereby a concrete base is formed by a slab footing poured on-site in the bottom of a dugout. Relatively low block walls are formed along the opposing side walls of the trench structure with or without rows of conventional concrete blocks positioned on the base. Atop the conventional blocks, if any, are a row of concrete cap blocks of the invention which are interlocked during construction with conventional mortar cement as illustrated in FIG. 3. In FIG. 8 these concrete cap blocks are opposingly placed atop the sidewalls of the trench structure with the cap blocks' face and front notch towards the center line thereof. A trench cover or grate plate is placed atop the trench structure and received in the upper front notchs of opposing cap blocks. The grating plate allows water to pass therethrough. The bottom surface of the trench structure is grouted or otherwise constructed with the required slope to provide proper drainage. Additional concrete may be poured on-site in the channels of the cap block and supporting conventional block (if any) with reinforcing bars added to improve the structural integrity as needed. A paving member such as asphalt pavement or a concrete slab is positioned on the support section of the cap block and reinforcing bars inserted in block channels to improve the structural rigidity between the paving member and the drain or chase side walls. Reinforcing bars are also inserted in the poured footing slab and extend through the conventional block channels and the cap block channels of the invention.

The cap block of the trench drain side wall as shown in FIG. 8 is seen enlarged in FIGS. 2–7 which demonstrates an upper notch in the face section and a shorter, rearward extending support section having a pair of vertical channels which is laterally offset from the face section and includes a horizontal extension to improve mating with adjacent blocks during wall construction. The concrete blocks of the invention as shown are formed at a factory and delivered to the job site where they are laid with conventional masonry tools and cement. The wall construction using such blocks has proven to be efficient and economical while providing the desired structural integrity.

Figure 1:
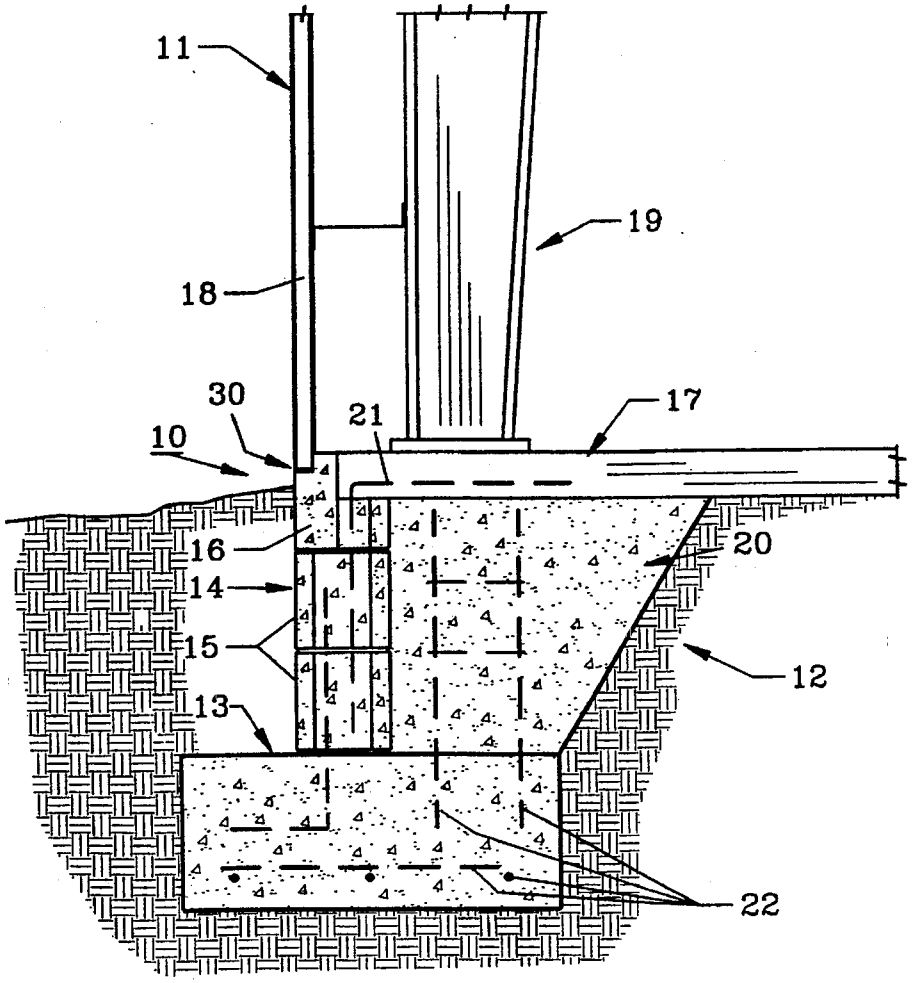
FIG. 1 illustrates a typical use of the wall system of the invention with a foundation wall showing the use of the novel wall block herein.

Another application of the wall system of the invention is shown in FIG. 1 whereby a concrete base is formed by a footing poured on-site and a relatively low block wall formed of two rows of conventional concrete blocks positioned thereon. Atop the conventional blocks are a row of concrete blocks of the invention which are interlocked during construction with conventional mortar cement by a mason as illustrated at FIG. 3. An exterior building wall is placed in the upper front notch and is tied to an internal vertical column. Additional concrete may be poured on-site between the foundation wall and the earth if necessary with reinforcing bars added to improve the structural integrity immediately below the internal vertical column. A floor member such as a concrete slab or a wooden floor joist is positioned on the upper wall block of the invention and reinforcing bars inserted in block channels to improve the structural rigidity between the floor member and the foundation wall.

DETAILED DESCRIPTION OF THE DRAWINGS AND OPERATION OF THE INVENTION

For a better understanding of the invention and its operation, turning now to the drawings, FIG. 1 illustrates foundation block wall system 10 for building 11 having a base consisting of concrete footing 13 and having an exterior foundation wall 14 positioned thereon. Foundation wall 14 consists of two rows of conventional concrete blocks 15 which are laid with mortar joints as is standard practice in the trade. Various numbers of rows of conventional blocks 15 may be used, or no conventional blocks used, depending on the particular building and/or site. Atop blocks 15 cap block 16 of the invention is shown as will hereinafter be more fully explained. Floor member 17 rests on cap block 16 and may be for example a wooden floor joist, a concrete floor slab or a paving member. Exterior outside building wall 18 may be preformed from metal such as aluminum, steel, wood, synthetics or otherwise and also rests on cap block 16 in notch 30. Concrete footing 13 is poured in place in ground 12 as is usual practice in the building trade. Concrete pier 20 with standard steel reinforcing bars 22 is shown atop footing 13 for supporting floor member 17 and building column 19. Concrete pier 20 may be for example eighteen inches in width. Positioned vertically above pier 20 is internal vertical building column 19 which is formed from structural steel. L-shaped steel tie rod 21 is attached to floor member 17 and passes through channel 23 of cap block 16 as seen in FIG. 3. As further shown in FIG. 1, tie rod 21 passes through wall block 16 and also through the channels formed in conventional concrete blocks 15. All such channels are filled with concrete during construction to insure a rigid assembly. As would be understood by those skilled in the art, the particular structure shown in FIG. 1 is but one of many types that could employ cap block 16 and wall system 10.

Cap block 16 is of unique design and allows a foundation wall to be quickly and conveniently completed. Cap block 16 is a specially designed inter-mating reinforced or non-reinforced modular block which can be used to eliminate the field forming of concrete floor slabs below, at, or above existing site grades. Cap block 16 allows the integral reinforcement connection of foundation wall 14 or drain wall 16 and floor member 17 or paving member 39, 39' while providing a self-flashing edge into which exterior wall 18 or grating 36 can be placed. When used alone or in conjunction with present art masonry blocks, block 16 allows the placement of elevated concrete slabs and paving members without perimeter field forming.

Figure 6:
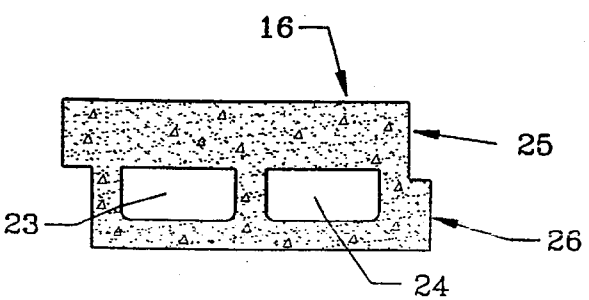
FIG. 6 illustrates a bottom view of the wall block as shown in FIG. 2.
Figure 5:
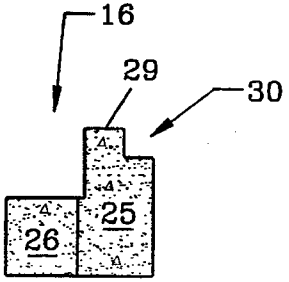
FIG. 5 depicts a left end view of the block as shown in FIG. 2.

Cap block 16 consists of face section 25 and support section 26 attached thereto as shown in FIGS. 2–6. Assembly of block 16 into a wall is shown in FIG. 3 demonstrating a pair of blocks 16 and includes mortar joint 28 therebetween. As would be understood, face section 25 shown at FIG. 7 and support section 26 of block 16 are cast or formed in a specially designed single mold from concrete as are conventional concrete wall blocks 15. Support section 26 has a height of approximately four inches whereas the overall height of face section 25 as shown in FIG. 5 is seven and five-eighths inches. This differential of three and five-eighths inches allows for floor member 17 or paving member 39, 39' to be formed and placed therein with its upper surface flush with block top surface 29. The front upper edge of face section 25 of block 16 defines a notch 30 which allows exterior building wall 18 to rest therein as shown in FIGS. 1, 5 and 6 or for supporting trench cover or grating plate 36 as shown in FIG. 8. Notch 30 has a height of one and one-half inches and a depth of one and one-half inches to accommodate grating plates and most metal building exterior walls which may be insulated or corrugated.

Figure 7:
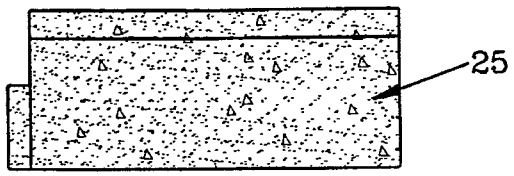
FIG. 7 presents a front view of the wall block as seen in FIG. 4.
Figure 2:
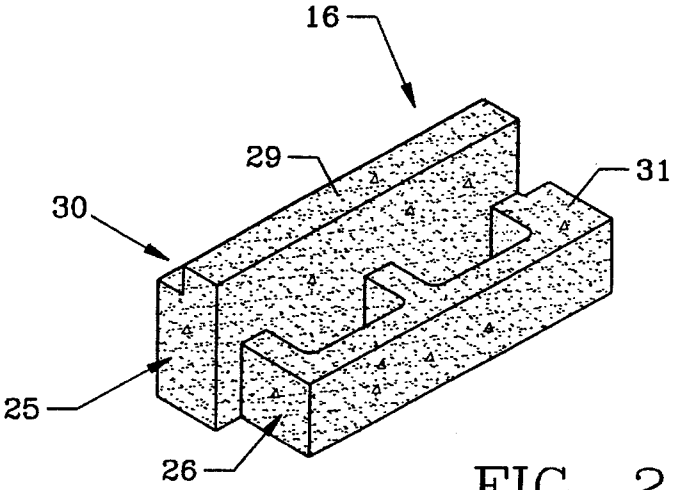
FIG. 2 demonstrates a perspective right end, top and rear view of the novel wall block as used in FIG. 1.
Figure 4:
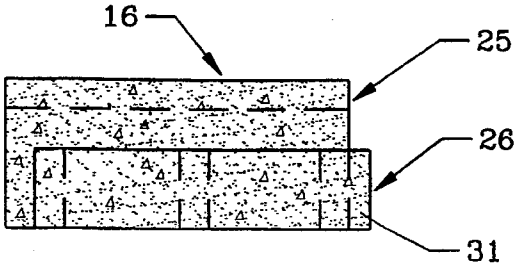
FIG. 4 shows a rear elevational view of the block as shown in FIG. 2.

It should be noted that support section 26 as seen in FIGS. 2, 3 and 7 is horizontally offset laterally behind face section 16. This offset accommodates horizontal side extension 31 as shown in FIGS. 2–4. Horizontal side extension 31 extends laterally one and one-eighths inches beyond the side surface of the face section 25 to increase the integrity of block wall system 10 as featured in FIG. 1. As further shown in FIGS. 2 and 3, horizontal side extension 31 likewise has a lesser depth than support section 26. The depth of horizontal extension 31 may be for example only three and five-eighths inches whereas the depth of support section 26 may be four inches as illustrated in FIGS. 3, 5 and 6. Also, as earlier explained, the height of support section 26 is substantially less than the overall height of face section 25 to which it is formed to accommodate floor member 17 or paving member 39, 39'. The length of face section 25 may be for example fifteen and five-eighths inches long whereas the length of support section 26 may be sixteen and three-quarters inches long, as seen in FIGS. 2, 4, and 5, including horizontal extension 31 to account for the mortar joint. The depth of face section 25 may be three and one-half inches whereas the depth of support section 26 is greater, for example four and one-eighth inches as illustrated in FIG. 2. Other sizes and dimensions of block 16 may also be formed.

The top view of cap block 16 as shown in FIG. 3 and a bottom view thereof is shown in FIG. 6 illustrating channels 23, 24 which are formed to improve handling convenience by making the block lighter for economy in manufacturing and to allow L-shaped tie rods 21 as shown in FIGS. 1 and 8 to pass therethrough afterwhich concrete or the like can be used to fill channels 23, 24 for structural improvement.

As seen in FIG. 8, blocks 16 are opposingly placed atop side walls 35, 35' of trench 40 formed from conventional concrete wall blocks 15. Trench cover or grating plate 36 is positioned atop trench 40 to allow water to pass therein. As seen, grating plate 36 is received within front notches 30 of blocks 16. Bottom drain surface 37 of trench 40 is grouted or otherwise constructed with the required slope. While a conventional trench drain is seen at FIG. 8, floor chases or the like could be constructed by closing trench 40 with a plate in lieu of grate 76. L-shaped tie rods 21 as earlier described are set in paving members 39, 39' to add strength and rigidity to side walls 35, 35'. L-shaped tie rods 21 are set in concrete footing slab 41 to add strength and rigidity to sidewalls 35, 35'. Also U-shaped tie rod 42 is set in slab 41 to add strength and rigidity to sidewalls 35, 35'. The channels of cap blocks 16 and conventional blocks 15 are filled with concrete during construction to insure rigid assembly.

Various other sizes of wall block 16 can be manufactured and other materials other than concrete can be used for molding cap block 16 of the invention. The illustrations and examples shown herein are merely for explanatory purposes and are not intended to limit the scope of the appended claims.

I claim:

1. A trench structure for a drain or chase comprising:

(a) a first cap block of uniform concrete composition, said first cap block comprising: a face section, said face section having rear, front, top, bottom, and side surfaces, said front surface defining a notch along the top edge, a support section, said support section defining a vertical channel, said channel extending the entire height of said support section, said support section having rear, front, top, bottom, and side surfaces, said front surface of said support section joined to said rear surface of said face section, said support section horizontally offset laterally from said face section, said bottom surface of said support section flush with said bottom surface of said face section, said support sections having a height less than said face section;

(b) a second cap block of uniform concrete composition, said second cap block comprising: a face section, said face section having rear, front, top, bottom, and side surfaces, said face section defining a notch along the top edge, a support section, said support section defining a vertical channel, said channel extending the entire height of said support section, said support section having rear, front, top, bottom, and side surfaces, said front surface of said support section joined to said rear surface of said face section, said support section horizontally offset laterally from said face section, said bottom surface of said support section flush with said bottom surface of said face section, said support section having a height less than said face section, said first cap block front surface opposingly positioned to said front face of said second cap block and spaced therefrom to form a channel therebetween, the face sections of said first cap block and said second cap block having flat rear surfaces; and (c) a drain cover, said cover positioned between said first and said second cap blocks and resting within said notches thereof.

2. The structure as claimed in claim 1 wherein said first cap block front face section surface is substantially parallel to said second cap block front face section surface.

3. The structure as claimed in claim 1 including a bottom drain surface, said bottom drain surface connecting the front surface of said face section of said first cap block with the front surface of said face section of said second cap block.

4. The structure as claimed in claim 3 wherein said bottom drain surface is sloped.

5. The structure as claimed in claim 1 wherein said bottom surface of said face section and said bottom surface of said support section are flat.

6. The structure as claimed in claim 1 including a horizontal extension, said horizontal extension joined to a side surface of said support section.

7. A method of forming a trench structure for a chase or drain comprising the step of:

(a) Placing a first cap block of uniform concrete composition comprising: a face section, said face section having side, front, top, bottom, and flat rear surfaces, said front surface defining a notch along the top edge; a support section, said support section having a vertical channel, said channel extending an entire height of said support section, said support section having rear, front, top, bottom, and side surfaces, said front surface of said support section joined to said rear surface of said face section, said support section horizontally offset laterally from said face section, said bottom surface of said support section flush with said bottom surface of said face section, and said support section having said height less than said face section;

(b) Positioning a second cap block of uniform concrete composition comprising: a face section, said face section having front, top, bottom, side, and flat rear surfaces, said face section defining a notch along the top edge, opposite and space from said first cap block so as the second cap block front face section surface faces said first cap block front face section surface to form a channel therebetween; a support section having a vertical channel, said channel extending an entire height of said support section, said support section having rear, front, top, bottom, and side surfaces, said front surface of said support section joined to said rear surface of said face section, said support section horizontally offset latterly from said face section, said bottom surface of said support section flush with said bottom surface of said face section, and said support section having a height less than said face section; and (c) Positioning a cover in said notches of said first and said second cap blocks.

8. The method as claimed in claim 7 wherein positioning the second cap block comprises positioning the second cap block front face section parallel to said first cap block front face section surface.

9. The method as claimed in claim 7 including the step of connecting the front face section surface of said first cap block to the front face section surface of said second cap block with a bottom drain surface having a slope.

10. The method as claimed in claim 7 including placing said first cap block on a conventional building block and positioning said second cap block on a conventional building block.

11. The method as claimed in claim 7 and including the step of inserting a reinforcing bar in said vertical channel.

12. The method as claimed in claim 7 including the step of positioning a paving member on said support section.

13. A trench structure for a drain or chase comprising: a first and a second cap block, said first and second cap block each of uniform concrete composition, said first and said second cap block each comprising: a face section, said face section having rear, front, top, bottom, and first and second side surfaces, said face section defining a notch along the front top edge; a support section, said support section defining a vertical channel, said vertical channel extending the entire height of said support section, said support section having rear, front, top, bottom, and first and second side surfaces, the longitudinal length of said support section less than the longitudinal length of said face section, said front surface of said support section joined to said rear surface of said face section, said first side surface of said support section flush with said first side surface of said face section; a horizontal extension, said horizontal extension longitudinally extending from said first side surface of said support section and having a depth less than the depth of said support section, said bottom surface of said support section flush with said bottom surface of said face section, said support section having a height less than said face section wherein said first side surface of said face section, said first side surface of said support section and said horizontal extension for complementary reception of second side surfaces of an adjacent cap block, said first cap block front surface opposingly positioned to said front face of said second cap block and spaced therefrom to form a channel therebetween, a drain cover, said cover positioned between said first and said second cap blocks and resting within said notches thereof.

14. The structure as claimed in claim 13 wherein said bottom surface of said face section and said bottom surface of said support section of said cap blocks are flat.

15. The structure as claimed in claim 13 wherein said first cap block front face section surface is substantially parellel to said second cap block front face section surface.

16. The structure as claimed in claim 13 including a bottom drain surface, said bottom drain surface connecting the front surface of said face section of said first cap block with the front surface of said face section of said second cap block.

17. The structure as claimed in claim 16 wherein said bottom drain surface is sloped.

* * * * *